United States Patent [19]

Pansolli et al.

[11] 4,443,267

[45] Apr. 17, 1984

[54] METHOD AND APPARATUS FOR THE CONTINUOUS SEPARATION OF FRUCTOSE FROM GLUCOSE STARTING FROM INVERT SUGAR OR FROM ISOMERIZED GLUCOSE SYRUPS

[75] Inventors: Paolo Pansolli; Aurelio Barbaro, both of Rome; Adriano Maimone, Guidonia; Mario Valdiserri, Monterotondo, all of Italy

[73] Assignee: E.N.I. Ente Nazionale Indrocarburi, Rome, Italy

[21] Appl. No.: 466,846

[22] Filed: Feb. 16, 1983

Related U.S. Application Data

[63] Continuation of Ser. No. 213,654, Dec. 5, 1980, abandoned.

[30] Foreign Application Priority Data

Feb. 22, 1980 [IT] Italy ..... 20105 A/80

[51] Int. Cl.[3] ..... C13D 3/14

[52] U.S. Cl. ..... 127/46.2; 210/264; 210/284; 210/424; 210/670

[58] Field of Search ..... 127/46.1, 46.2, 463; 210/264, 284, 670, 424

[56] References Cited

U.S. PATENT DOCUMENTS

| | | | |
|---|---|---|---|
| 3,131,232 | 4/1964 | Broughton et al. | 210/670 |
| 3,806,363 | 4/1974 | Takasaki | 127/46.1 |
| 4,133,696 | 1/1979 | Barker et al. | 127/46.1 |
| 4,157,267 | 6/1979 | Odawara et al. | 127/46.2 |
| 4,182,633 | 1/1980 | Ishikawa et al. | 127/46.1 |
| 4,319,929 | 3/1982 | Fickel | 127/46.2 |

FOREIGN PATENT DOCUMENTS 2391754 12/1978 France .

*Primary Examiner*—Peter Chin

*Attorney, Agent, or Firm*—Morgan, Finnegan, Pine, Foley & Lee

[57] ABSTRACT

A method for separating fructose from glucose in mixture containing both sugars is disclosed, wherein the separation is carried out with anion-exchange resins in bisulfite form in a 3-column-system which is fed continuously from bottom to top. The process permits the simultaneous collection of both glucose and fructose which are separated in have a minimum dilution, the chromatographic bed being wholly expolited, thus making the instant process economically interesting.

3 Claims, 10 Drawing Figures

METHOD AND APPARATUS FOR THE CONTINUOUS SEPARATION OF FRUCTOSE FROM GLUCOSE STARTING FROM INVERT SUGAR OR FROM ISOMERIZED GLUCOSE SYRUPS

This is a continuation, of application Ser. No. 213,654, filed Dec. 5, 1980 now abandoned.

This invention relates to a method and an apparatus for separating, with the aid of anionic exchange resins, fructose from glucose in the glucose syrups which have been isomerized with glucose-isomerase and in the solutions of invert sugar. p The technical literature reports a great number of publications and patent specifications in which the use of ion-exchange resins is suggested for the separation of these two sugars from one another.

In his paper, published in 1953 with the title "Ion-exchangers in analytical chemistry", pages 189–198, the author Samuelson has shown, for the first time, that bisulfite-form anion-exchange resins are capable of separating glucose from fructose.

The U.S. Pat. No. 3,806,363, dated Apr. 23, 1974, Y. Takasaki et al., assigned to Agency of Industrial Science and Technology, Tokyo, Japan, discloses a separation process of the kind referred to above. This method is essentially based on the well known chromatograpic method consisting in charging the sugar mixture to the top end of a resin-filled column and subsequently collecting, by elution with water, a number of fractions rich with the two sugars which have been separated.

In such a method the feed of the sugar mixture must be interrupted in order to permit that water may be fed-in until the separated fractions of glucose and fructose have been collected. Once the elution of these fractions has been completed, the sugar solution which contains the isomerides to be separated is fed-in again.

Such a procedure is objectionable from the economical standpoint due to the high dilution of the two sugars which have been separated and, in addition, the degree of separation is comparatively low: in practice, the method is a common chromatographic procedure.

The present invention, conversely, is based on a procedure which is entirely original and which comprises the step of continuously feeding, from bottom to top a plural-column system which contain the active anion-exchange resin, the separated glucose and fructose being simultaneously collected at the exit of the system.

The collected glucose can be isomerized again to give fructose and then separated. This procedure essentially differs from the conventional ones because of the operational continuity and the separation technique.

Figure 1:
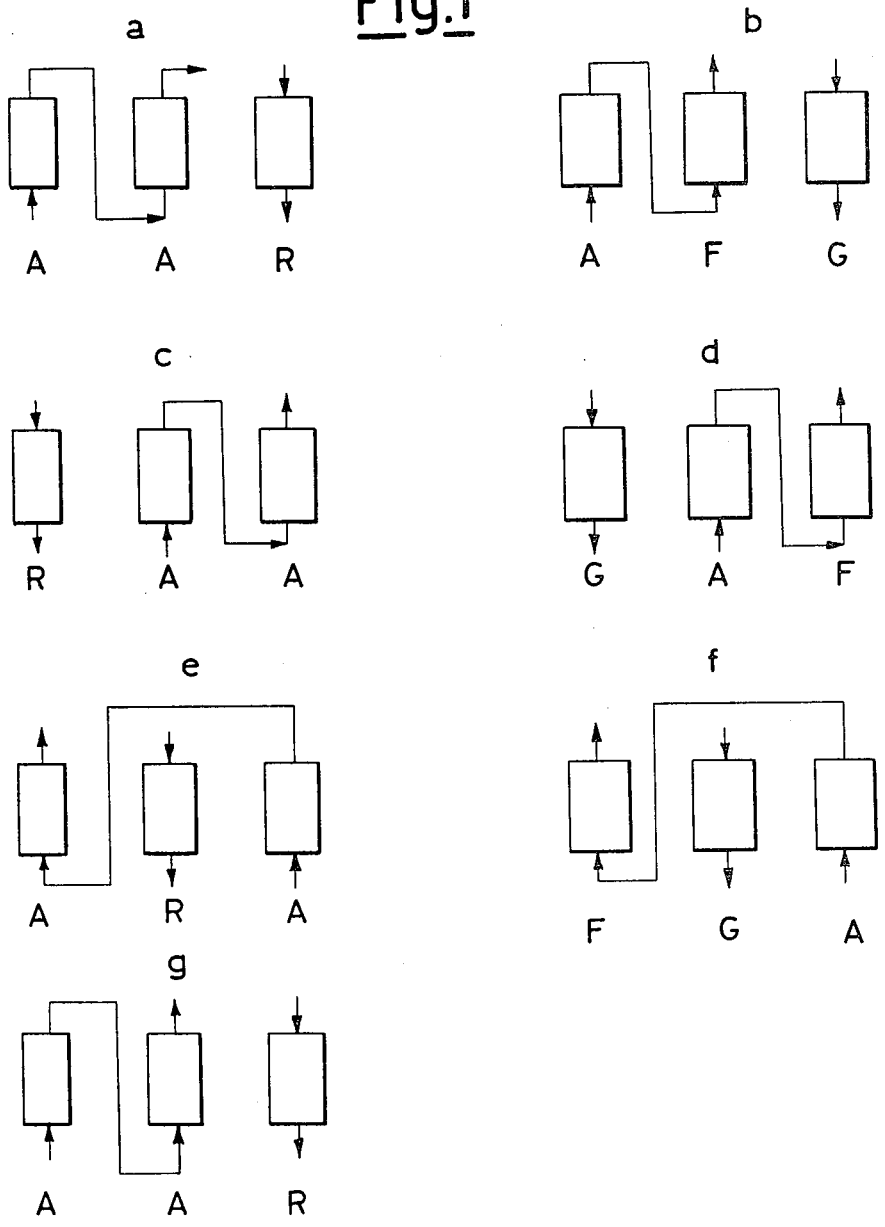
FIG. 1 shows the sequence of working steps of the separating system.

Table 1, and FIG. 1 of the drawings, are illustrative of the sequence of the working steps of the system, which adopted 3 columns. Apart from the system starting stage, and considering the steady state operation, the operative cycle of the system can be described as follows.

Column 1 is fed from the bottom with a sugar mixture which ascends in the interior of the column and exits the column top after having been enriched with fructose. The exiting solution is then fed, still from bottom to top, to the second column. The third column, when in steady state operation, is saturated with glucose and impregnated with the sugar mixture: therefore, concurrently with the operations just now described, the discharge of the mixture which impregnates the third column is carried out.

These stages, which are simultaneous, are plotted in the diagram (a) of FIG. 1. Immediately thereafter, which roughly corresponds to the completion of the step of discharging the mixture from the 3rd column, the following situation: column 1 is still fed with the mixture to be split, whereas from the top pf column 2 a solution of fructose only exits. From column 3 glucose, which has been retained by the resin, is eluted and a solution of glucose only is obtained.

In the following stage (diagram c) of FIG. 1), the resin in the column 1 is now saturated with glucose, and is no longer capable of carrying out any separation, so that the impregnation mixture is discharged and the feed of the mixture which contains the two isomerides is shifted to the second column, wherefrom a fructose-enriched solution is now drawn, which is sent to the third column.

The diagram (d) shows the next stage.

Glucose is eluted from the column 1, whereas the column 2 is still fed with the mixture of the two isomerides, while the fructose solution is drawn from the top of the third column.

At this stage, the column 2 is the one which is no longer capable of contributing towards the separation so that it is emptied of the impregnating mixture and the stream exiting the column 3 is sent to the column 1 which has now been regenerated.

The diagram (f) shows the elution of glucose from the column 2 and the production of fructose from the column 1, whereas the mixture of the two isomerides is fed to the column 3 again. By so doing, a series of production cycles is concluded, to be repeated exactly in the same way a number of times. As can be seen, the diagram (g) returns to coincide with the diagram (a).

The principal advantages afforded by the method according to this invention are:

1. A minimum dilution of the sugars which are separated due to a perfect stratification of the sugar mixture on the resin-washing water. Such a perfect stratification of the sugar mixture is a direct consequence of the feed from bottom to top.

2. Exploitation of the entire chromatographic bed of the resin, the result being a high fructose yield.

3. A continuous use of the chromatographic separation system.

4. An economically statisfactory run.

The principal features of the method are described hereinafter.

A strongly basic anion-exchange resin is used (Amberlite IRA-400, Duolite A 101 D), composed by quaternary ammonium groups bonded to a divinyl-benzene styrene polymer which has been cross-linked to an extent of from 6% to 10%. The resin is activated by an aqueous solution of 5% sodium metabisulfite. The processing temperature is comprised between 30° C. and 60° C., the value of 50° C. being preferred. The length of the resin layer is from 2 to 6 meters, a value of from 3 to 4 meters, and also 5 meters, being preferred. The mixture of the two sugars is fed at a solids concentration (dry matter) of from 30% to 70%, the rate of flow being comprised between 0.2 cubic meter and 1.5 cubic meter an hour per square meter of cross-sectional area of the adsorbant bed.

Glucose desorption and switching of the sugar mixture from a saturated column to the subsequent, active, column, is obtained with water at a rate of flow equal to that of the incoming mixture to be split.

The method according to this invention is described in a more detailed manner by the following examples.

EXAMPLE 1

PRODUCTION OF FRUCTOSE FROM INVERT SUGAR

Apparatus: a glass column is used, having a diameter of 5 cm and a height of 100 cm, fitted with a water-recirculation heating jacket. The height of the resin bed required for the separation is obtained by arranging 3 columns in series to make up a total length of 300 cm and a volume of 6 liters.

The resin used is Amberlite IRA-400 (Rohm & Haas).

A Watson-Marlox pump (M.H.R.E.-100) is used both for feeding the system with the sugar mixture and for removing said mixture from the column which contains the saturated resin.

Analytical Methods

The effect of the separation is checked at each column exit, and, more particularly, at the fructose-producing column, by polarimetric measurements of the rotation angle (Perkin Elmer E 141 polarimeter) and by refractive index measurements (Abbe refractometer). More accurate analyses are carried out gas-chromatographically.

Operational Procedure

Figure 2:
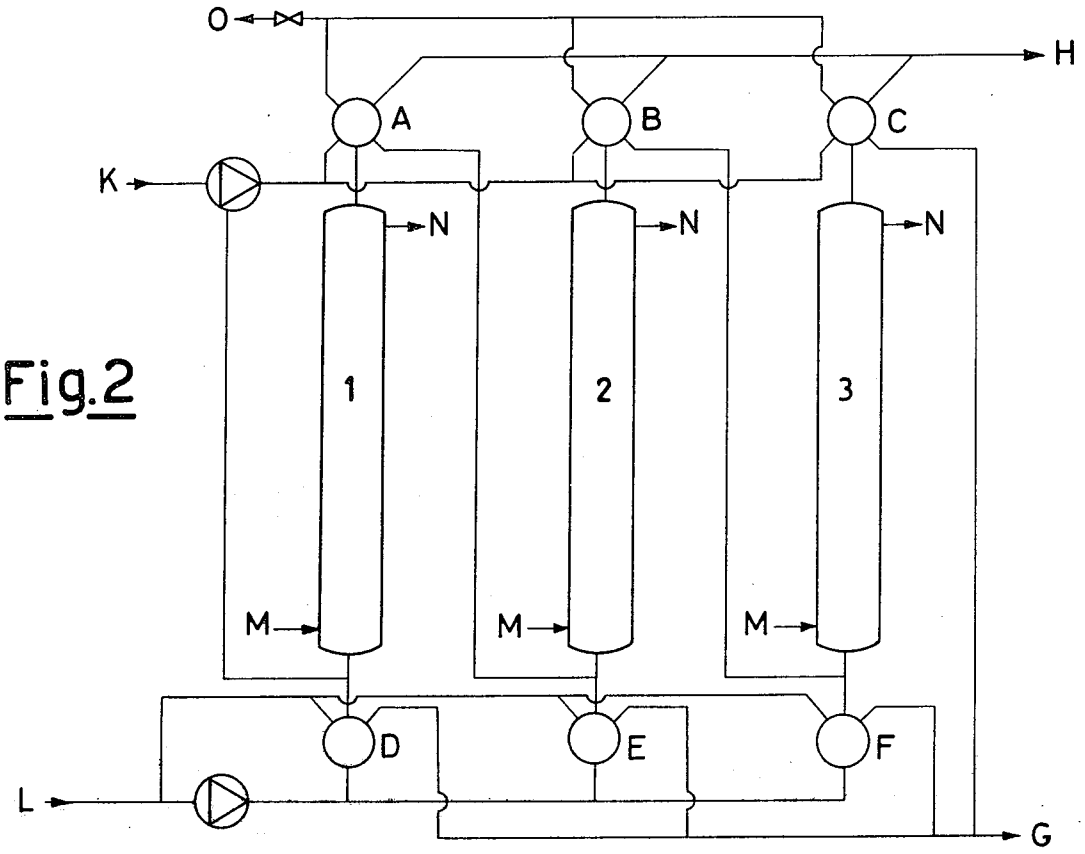
FIG. 2 shows a flow sheet of the separating system.

The columns, thermostatically controlled at 50° C., are filled with the water-dispersed resin. The activation of the resin takes place by causing 12 liters of a 5% aqueous solution of sodium bisulfite to flow therethrough at a rate of flow of 6 liters an hour. The excess metabisulfite is removed by washing the resin with about 18 liters of water. The thusly activated resin retains its initial separating ability for at least 200 production cycles. The flow sheet of the system is shown in FIG. 2, wherein fructose exits at H and glucose exits at G; 1,2 and 3 indicate the thermostatically controlled columns which contain the resin. M and N are the inlet and the outlet of the heating fluid, whereas K and O are the inlet and outlet water mains, respectively. A,B and C are 4-way valves, and D,E and F are 3-way valves.

The pilot plant is fed at a rate of flow of 0.83 liters an hour with an invert sugar consisting of glucose and fructose in equal parts with a dry solids content of 60% (wt/vol). After a short start up stage, the pilot plant produces, through alternating repetitive cycles, fructose separated from glucose and the mixture of the two is fed back to the storage tank. Table 1 reports in detail the volumes and the times relative to the first 13 production cycles and the operational conditions. The fructose so collected has a purity of 93% and a dry matters content (wt/vol) of from 20% to 30%. The glucose fed back to siomerization has a purity of 73%–85% and a concentration of dry matters comprised between 28% and 32% (wt/vol). The mixture returned to the storage tank has a composition of the two sugars which is unaltered and a dry matter content between 57% and 59% (wt.vol).

The yield of fructose of the present method relative to the fed-in mixture is about 10%–15% by wt. The output is 0.2 kg of fructose (93% pure) a day per liter of resin.

EXAMPLE 2

INFLUENCE OF THE HEIGHT OF THE RESIN BED ON THE SEPARATION ABILITY

Figure 3:
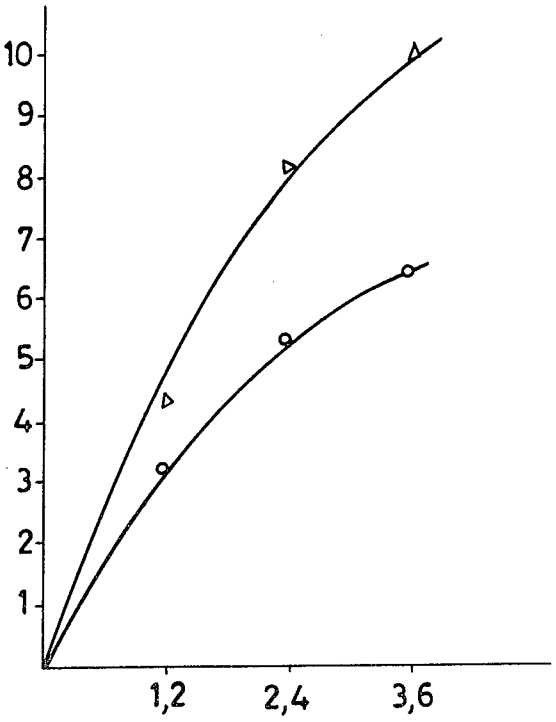
FIG. 3 shows the relationship between the amount of fructose separated at 93% and 90% purity and the height of the resin bed.

FIG. 3 shows the relationship between the amount of fructose separated at 93% and 90% purity and the height of the resin bed. The ordinate report the actual dry matter in terms of g/meter, while the abcissa reports the height of the resin layer in meters.

There have been used for this test three columns, all with a diameter of 1.6 cm and with heights of 120 cm, 240 cm and 360 cm, respectively, filled with Amberlite IRA 400 activated in bisulfite form. The resin is maintained at 50° C. by circulation of thermostatically controlled water in the outer jacket of the column. The bed is fed with a solution of invert sugar at 100% with a content of dry matter of 50% (wt/wt) at a linear speed of 30 cm an hour. The analytical technique used is the same as in Example 1. The plot shows that, for this flow rate, the height of the bed which is the optimum is increased as the degree of purity of the product is decreased, but it never exceeds 240 cm in the two cases.

EXAMPLE 3

INFLUENCE OF THE FEEDING SPEED ON THE SEPARATION ABILITY

Figure 4:
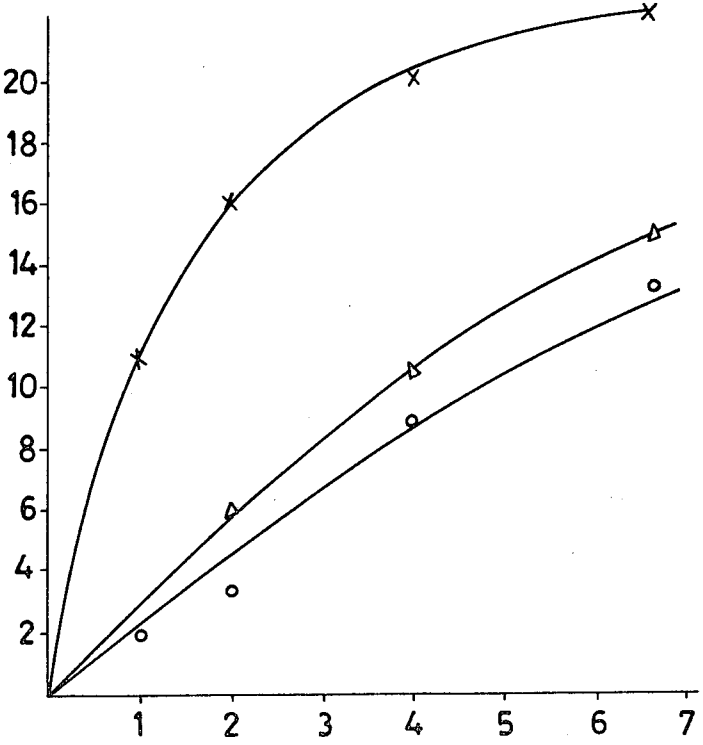
FIG. 4 show the relationship between the amount of glucose which has been separated at 93%, 90% and 75% purity and the speed at which the sugar mixture is fed.

FIG. 4 shows the relationship between the amount of glucose which has been separated at 93%, 90% and 75% purity and the speed at which the sugar mixture is fed, v. The ordinate reports the actual dry matter in g/m and the ordinate 1:v is expressed in hour·meter$^{-1}$. The first product has an interest for producing crystalline fructose, the others for obtaining syrups having a high sweetening power as widely used in the food industries. For this test, a column having a diameter of 1.6 cm and a height of 360 cm has been used, filled with Amberlite IRA-400, activated in bisulfite form and maintained at 50° C. The column has been fed with an invert sugar having a dry matter content of 50% (wt/wt), at four linear speeds, of 15 cm·hour, 25 cm/hour, 50 cm/hour and 100 cm/hour, respectively. As can be seen in the plot, as the degree of purity of the product is decreased, the optimum feeding speed is increased.

The symbols which have been used as experimental points of FIGS. 3 and 4 represent various degrees of purity of fructose, expressed in terms of %-fructose, viz.: O=93% fructose—Δ=90% fructose—X=70% fructose.

EXAMPLE 4

PRODUCTION OF FRUCTOSE FROM GLUCOSE

The instant example describes a case in which fructose is produced directly from glucose by isomerization with glucose-isomerase and separation on resin. The apparatus used for this purpose is a jacketed column (7.8 cm by 90 cm) filled with 1 kg of cellulose acetate spherules including Arthrobacter sp. cells and by a system of three jacketed columns arranged serially for a total length of 450 cm and a volume of 28.5 liters, filled with Duolite A 101 D resin (Diaprosin) activated in bisulfite form. The isomerization of glucose takes place continuously by feeding the glucose-isomerase column, thermostatically controlled at 60° C., with a solution at pH 7 of 50-Brix glucose. At a rate of flow of 2 liters an hour, there is a conversion of 48% of glucose to fructose. The syrup in question is then fed at the same rate of flow to the three separation columns, so that there is obtained, in repeated alternate cycles, fructose separated from glucose. Such a separation is made according to the procedure set forth in Example 1, with the difference that the installation is larger and produces 6 kg a day of 93% pure fructose. The collected glucose is supplemented by additional glucose until attaining a concentration of 50° Brix and the resultant syrup is sent to the isomerization column again.

TABLE

PRODUCTION OF 93%-PURE FRUCTOSE

| Production Cycles, N° | Time hrs | Oper. stages of Col. 1 | 2 | 3 | Fructose Product. kg | Collected Glucose kg |
|---|---|---|---|---|---|---|
| | | A | | | | |
| | 1,18 | | | | | |
| | | A | A | | | |
| | 2,36 | | | | | |
| | | R | A | A | | |
| | 3,54 | | | | | |
| 1 | | G | A | F | 0,11 | 0,14 |
| | 4,54 | | | | | |
| | | A | R | A | | |
| | 6,12 | | | | | |
| 2 | | F | G | A | 0,22 | 0,28 |
| | 7,12 | | | | | |
| | | A | A | R | | |
| | 8,30 | | | | | |
| 3 | | A | F | G | 0,33 | 0,42 |
| | 9,30 | | | | | |
| | | R | A | A | | |
| | 10,48 | | | | | |
| 4 | | G | A | F | 0,45 | 0,56 |
| | 11,48 | | | | | |
| | | A | R | A | | |
| | 13,05 | | | | | |
| 5 | | F | G | A | 0,56 | 0,70 |
| | 14,06 | | | | | |
| | | A | A | R | | |
| | 15,24 | | | | | |
| 6 | | A | F | G | 0,67 | 0,84 |
| | 16,24 | | | | | |
| | | R | A | A | | |
| | 17,43 | | | | | |
| 7 | | G | A | F | 0,78 | 0,98 |
| | 18,43 | | | | | |
| | | A | R | A | | |
| | 20,00 | | | | | |
| 8 | | F | G | A | 0,89 | 1,12 |
| | 21,00 | | | | | |
| | | A | A | R | | |
| | 22,18 | | | | | |
| 9 | | A | F | G | 1,00 | 1,26 |
| | 23,18 | | | | | |
| | | R | A | A | | |

TABLE-continued

PRODUCTION OF 93%-PURE FRUCTOSE

| Production Cycles, N° | Time hrs | Oper. stages of Col. 1 | 2 | 3 | Fructose Product. kg | Collected Glucose kg |
|---|---|---|---|---|---|---|
| | 0,36 | | | | | |
| 10 | | G | A | F | 1,12 | 1,40 |
| | 1,36 | | | | | |
| | | A | R | A | | |
| | 2,54 | | | | | |
| 11 | | F | G | A | 1,23 | 1,54 |
| | 3,54 | | | | | |
| | | A | A | R | | |
| | 5,12 | | | | | |
| 12 | | A | F | G | 1,35 | 1,70 |
| | 6,12 | | | | | |
| | | R | A | A | | |

A = Mixture feed;
F = fructose production
R = Mixture recycling;
G = glucose collection

We claim:

1. A method of continuously separating fructose from glucose in a system comprising a plurality of serially interconnected columns each containing an anion-exchange resin in bisulfite form, said method, in steady state conditions, comprising:

(a) introducing a feed mixture containing fructose and glucose into the bottom end of a first one of said columns;

(b) occluding a fraction of glucose from said feed mixture on said resin contained in said first column;

(c) withdrawing from the upper-end of said first column an effluent comprising a fructose-enriched mixture;

(d) introducing said fructose-enriched effluent mixture withdrawn from the upper end of the first and each successive column to the bottom end of the next successive column;

(e) occluding on the resin contained in each successive column a fraction of glucose from the fructose-enriched mixture introduced thereinto;

(f) recycling the fructose-enriched effluent mixture withdrawn from the upper end of the last of said columns to the first of said columns as a feed mixture for step (a);

(g) repeating steps (a) through (f) until the effluent mixture of one of said columns comprises essentially a solution of fructose;

(h) collecting said fructose solution;

(i) repeating steps (a)–(g) until one of said columns is saturated with glucose;

(j) bypassing said glucose saturated column from said system until said glucose is eluted therefrom thereby regenerating said resin in said column for further use in said system; and (k) eluting glucose solution from said glucose-saturated column.

2. A method as defined in claim 1 wherein steps (i), (j) and (k) occur simultaneously with steps (f), (g) and (h).

3. A method as defined in claim 1 wherein said system comprises three columns.

* * * * *